US009892607B2

(12) United States Patent
Hemanes

(10) Patent No.: US 9,892,607 B2
(45) Date of Patent: Feb. 13, 2018

(54) FIREARM MOUNTED FIRING ALARM SYSTEM

(71) Applicant: Erik Hemanes, Lithonia, GA (US)

(72) Inventor: Erik Hemanes, Lithonia, GA (US)

( * ) Notice: Subject to any disclaimer, the term of this patent is extended or adjusted under 35 U.S.C. 154(b) by 0 days.

(21) Appl. No.: 15/214,228

(22) Filed: Jul. 19, 2016

(65) Prior Publication Data

US 2017/0132895 A1 May 11, 2017

Related U.S. Application Data

(60) Provisional application No. 62/194,250, filed on Jul. 19, 2015.

(51) Int. Cl.

| | |
|---|---|
| ***G08B 21/00*** | (2006.01) |
| ***G08B 21/02*** | (2006.01) |
| ***G08B 3/00*** | (2006.01) |
| ***G08B 5/36*** | (2006.01) |

(52) U.S. Cl.
CPC ..... *G08B 21/02* (2013.01); *G08B 3/00* (2013.01); *G08B 5/36* (2013.01)

(58) Field of Classification Search
CPC ..... F41C 33/029; F41A 17/063
USPC ..... 340/540
See application file for complete search history.

(56) References Cited

U.S. PATENT DOCUMENTS

| | | | | |
|---|---|---|---|---|
| 5,917,775 | A | 6/1999 | Salisbury | |
| 6,552,963 | B2 | 4/2003 | Baranek et al. | |
| 6,568,116 | B2 | 5/2003 | Hathaway | |
| 7,360,332 | B2 | 4/2008 | Rozovsky | |
| 7,714,720 | B2 | 5/2010 | Hietanen et al. | |
| 2003/0021188 | A1* | 1/2003 | Baranek | G08B 7/066 367/136 |
| 2008/0204231 | A1* | 8/2008 | Hietanen | F41A 17/063 340/568.1 |
| 2010/0321186 | A1 | 12/2010 | Crook | |
| 2014/0190051 | A1* | 7/2014 | Wichner | F41A 17/12 42/1.05 |
| 2014/0218518 | A1 | 8/2014 | Oliver | |
| 2015/0256990 | A1* | 9/2015 | Vilrokx | H04W 76/007 455/404.1 |
| 2016/0209173 | A1* | 7/2016 | Dribben | F41J 5/06 |
| 2017/0010062 | A1* | 1/2017 | Black | F41A 17/063 |

* cited by examiner

*Primary Examiner* — Fabricio R Murillo Garcia
(74) *Attorney, Agent, or Firm* — The Keys Law Firm PLLC

(57) ABSTRACT

A firearm mounted firing alert system for generating and transmitting alerts upon the discharge of a firearm to which it is attached. The firearm mounted firing alert system includes a device housing which includes an adhesive surface, a lighting element, a sensor set, a microcontroller, and a power source. The sensor set may embody a contact sensor for generating a contact alert whenever contact with the metallic surface of a firearm is lost, a vibration sensor for generating a vibration alert in response to a discharge vibration and a sound sensor for generating a sound alert in response to a discharge sound. Upon receiving these sensor alerts, the microcontroller transmits a notification over a networking interface to any device which has been preset to receive such notifications as well as cause the lighting element to illuminate.

3 Claims, 2 Drawing Sheets

FIREARM MOUNTED FIRING ALARM SYSTEM

CROSS REFERENCE TO RELATED APPLICATIONS

This application claims the benefit of and incorporates by reference U.S. provisional patent application Ser. No. 62/194,250 filed Jul. 19, 2015.

BACKGROUND OF THE INVENTION

Field of the Invention

This invention relates generally to a firearm safety mechanism and, more particularly, to an alarm system for a firearm that transmits a wireless alert upon the discharge of the firearm.

Description of the Prior Art

There have been numerous attempts to control the indiscriminant distribution and/or the careless or improper use of firearms. Indeed, the implementation of registration requirements, instructional classes, background checks, and waiting periods, as well as the use of gun cases and locks, have all been at least partially aimed at enhancing safety in relation to firearm ownership and use. A problem which still exists, however, is that such existing programs and devices are essentially useless for providing real time, ongoing monitoring of a firearm. Thus, there remains a need for a firing alarm system which would provide real time, remote notifications relating to the discharge of a firearm. It would be helpful if such a firing alarm system was mountable to a firearm such that it also provides such notification in the event an attempt is made to disable or remove it. It would be additionally desirable for such a firearm mounted firing alert system to utilize a plurality of sensors to provide redundancy in determining whether a firearm has been discharged.

The Applicant's invention described herein provides for a firearm mounted firing alert system adapted to provide real time, wireless alerts to one or more remote devices upon the discharge of a firearm. The primary components in Applicant's firearm mounted firing alert system are a housing, sensors, a networking interface and a controller. When in operation, the firearm mounted firing alert system enables more effective monitoring of a firearm's use so as to promote more careful handling and use. As a result, many of the limitations imposed by prior art structures are removed.

SUMMARY OF THE INVENTION

A firearm mounted firing alert system for generating and transmitting alerts upon the discharge of a firearm to which it is attached. The firearm mounted firing alert system comprises a device housing which includes an adhesive surface, a lighting element, a sensor set, a microcontroller, and a power source. The sensor set may embody a contact sensor for generating a contact alert whenever contact with the metallic surface of a firearm is lost, a vibration sensor for generating a vibration alert in response to a discharge vibration and a sound sensor for generating a sound alert in response to a discharge sound. Upon receiving these sensor alerts, the microcontroller transmits a notification over a networking interface to any device which has been preset to receive such notifications as well as cause the lighting element to illuminate.

It is an object of this invention to provide a firing alarm system which provides real time, remote notifications relating to the discharge of a firearm.

It is another object of this invention to provide a firing alarm system that is mountable to a firearm such that it also provides such notification in the event an attempt is made to disable or remove it.

It is yet another object of this invention to provide a firearm mounted firing alert system which utilizes a plurality of sensors to provide redundancy in determining whether a firearm has been discharged.

These and other objects will be apparent to one of skill in the art.

DETAILED DESCRIPTION OF THE INVENTION

Figure 1:
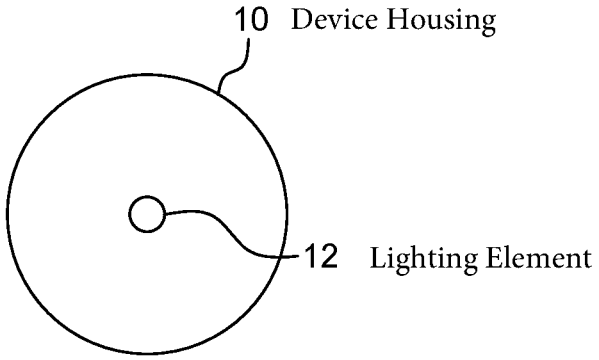
FIG. 1 is a top plan view of a firearm mounted firing alert system built in accordance with the present invention.
Figure 2:
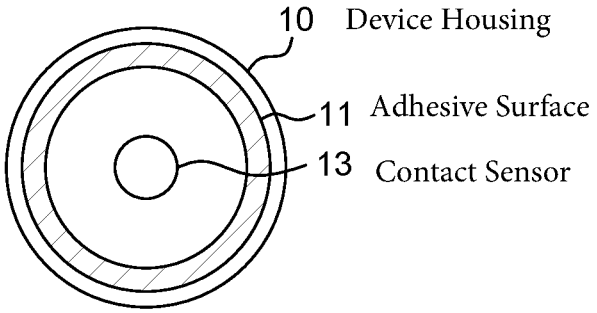
FIG. 2 is a bottom plan view of a firearm mounted firing alert system built in accordance with the present invention.
Figure 3:
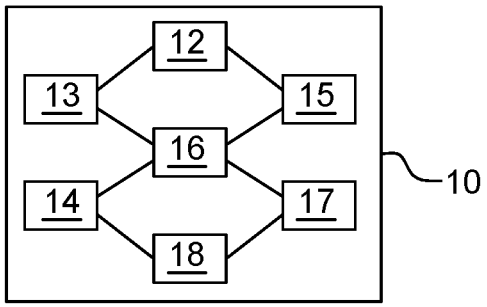
FIG. 3 is a schematic diagram of the components of a firearm mounted firing alert system built in accordance with the present invention.
Figure 4:
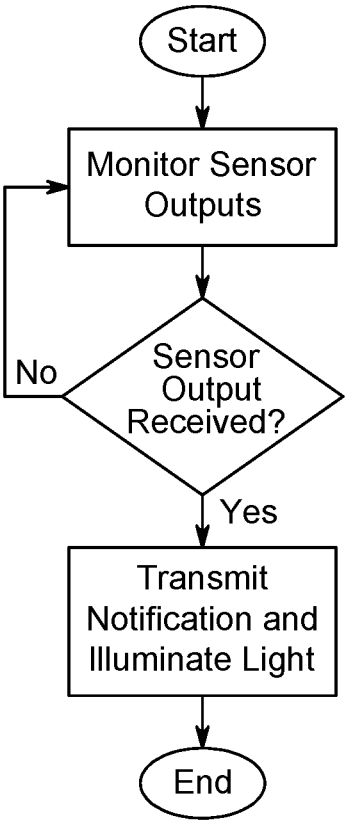
FIG. 4 shows the monitoring process of a firearm mounted firing alert system built in accordance with the present invention.

Referring now to the drawings and in particular FIGS. 1, 2, and 3, a firearm mounted firing alert system is implemented through a device housing 10 which includes an adhesive surface 11, as well as a set of electrical components which define a lighting element 12, a contact sensor 13, a vibration sensor 14, a sound sensor 15, a microcontroller 16, a power source 17, and a networking interface 18. In the preferred embodiment, each of the electrical components are electrically connected with both the power source 17 and the microcontroller 16.

The adhesive surface 11 defines a strip of permanent adhesive disposed on the surface of the device housing 10 so as to enable the device housing 10 to be permanently affixed to a firearm (not shown). In the preferred embodiment, it is desirable for the device housing 10 to be affixed to a metallic surface of a firearm, thereby enabling the operating of the contact sensor 13. In the preferred embodiment, the contact sensor 13 defines a magnetic contact switch which is operable to generate and transmit to the microcontroller a contact alert whenever contact with the metallic surface of a firearm is lost. In this regard, the contact sensor is configured to generate the contact alert in the event the device housing 10 is removed from a firearm to which it had been affixed.

It is appreciated that the contact sensor 13 is operative to generate an alert only when an existing metallic contact is broken; thus when the device housing 10 is not connected to a metallic surface on a firearm, the contact sensor 13 is not active.

The vibration sensor 14 and the sound sensor 15 provide redundant monitoring of the discharge state of a firearm to which the device housing 10 is affixed. The vibration sensor 14 is operative to generate and transmit to the microcontroller a vibration alert when vibration exceeding a threshold intensity that is indicative of a discharge of the firearm is sensed. The sound sensor 15 is operative to generate and transmit to the microcontroller a sound alert upon detecting a sound exceeding a threshold loudness that is indicative of a discharge of the firearm.

Upon receipt of one or more of the alerts from the sensors, the microcontroller 16 is operative to send a notification signal through the networking interface 18 and cause the lighting element 12 to illuminate. In the preferred embodiment, the networking interface 18 defines a wireless local area network ("WLAN") adapter and a Bluetooth antenna and the lighting element 12 defines an LED light that illuminates when supplied with electricity.

In one embodiment, the lighting element 12 defines a multi-color LED light that is caused to be illuminated in different colors depending on the type of alert received by the microcontroller 16.

It is contemplated that the microcontroller 16 can be programmed to send notifications to a plurality of different computer network enabled devices, including law enforcement personnel. In the preferred embodiment, the notification targets are programmed into the microcontroller 16 through a computer device that has been paired with the device housing 10 through a conventional bonding process (such as the conventional Bluetooth bonding process). Once programmed, the microcontroller 16 is operative to connect to the Internet through its networking interface 18 and transmit notifications to each notification target in the event it receives an alert from its sensors.

Referring now to FIG. 2, when the firearm mounted firing alert system is operational with a target firearm, its contact sensor, vibration sensor, and sound sensor remain in a standby mode until a relevant input is received which triggers their operation. Accordingly, if contact is lost with the firearm, a threshold exceeding vibration is felt, or a threshold exceeding noise is detected, the respective sensor will transmit its alert to the microcontroller. Upon receipt of such an output from the sensor(s), the microcontroller will transmit a notification over the networking interface to any device which has been preset to receive such notifications and cause the lighting element to illuminate. In the preferred embodiment, upon receipt of a contact alert a contact notification is sent by the microcontroller and the lighting element illuminates in a first color. Similarly, upon receipt of both a sound alert and a vibration alert, a discharge notification is sent by the microcontroller and the lighting element illuminates in a second color.

It is appreciated that contact notifications and discharge notifications may be transmitted to the same set of targets or different targets (with or without overlap).

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A firearm mounted firing alert system, comprising:

a device housing having a bottom surface, a processing device, a power source, a networking interface, and a lighting element;

an attachment member integral with said bottom surface, wherein said attachment member adapts the device housing to affix to the exterior of a firearm;

a contact sensor integral with said device housing and connected to said processing device and power source, wherein said contact sensor is defined by a magnetic contact switch operable to generate a contact alert in the event the device housing is removed from the firearm to which the device housing had been affixed;

a vibration sensor integral with said device housing and connected to said processing device and power source, wherein said vibration sensor is configured to generate a vibration alert in response to vibration from the discharge of the firearm to which the device housing had been affixed;

a sound sensor integral with said device housing and connected to said processing device and power source, wherein said sound sensor is configured to generate a sound alert in response to sound from the discharge of the firearm to which the device housing had been affixed; and wherein said processing device is adapted to transmit a notification signal over the networking interface and cause the lighting element to illuminate upon the generation of the contact alert and said processing device is adapted to transmit the notification signal and cause the lighting element to illuminate upon the generation of both the vibration alert and sound alert.

2. The firearm mounted firing alert system of claim 1, wherein said processing device defines a microcontroller.

3. The firearm mounted firing alert system of claim 1, wherein said attachment member defines an adhesive surface.

* * * * *